US009795868B2

(12) United States Patent
Miller

(10) Patent No.: US 9,795,868 B2
(45) Date of Patent: Oct. 24, 2017

(54) GAMES PLAYED WITH ROBOTS

(71) Applicant: Kenneth C. Miller, Aptos, CA (US)

(72) Inventor: Kenneth C. Miller, Aptos, CA (US)

( * ) Notice: Subject to any disclaimer, the term of this patent is extended or adjusted under 35 U.S.C. 154(b) by 0 days.

(21) Appl. No.: 15/490,763

(22) Filed: Apr. 18, 2017

(65) Prior Publication Data

US 2017/0225065 A1 Aug. 10, 2017

Related U.S. Application Data

(63) Continuation-in-part of application No. 14/051,309, filed on Oct. 10, 2013, now Pat. No. 9,623,319.

(60) Provisional application No. 61/870,480, filed on Aug. 27, 2013, provisional application No. 61/712,083, filed on Oct. 10, 2012.

(51) Int. Cl.

| | |
|---|---|
| ***A63F 9/24*** | (2006.01) |
| ***A63F 7/00*** | (2006.01) |
| ***A63F 7/30*** | (2006.01) |

(52) U.S. Cl.

CPC ..... *A63F 7/0023* (2013.01); *A63F 7/0058* (2013.01); *A63F 7/307* (2013.01); *A63F 9/24* (2013.01); *A63F 2007/0047* (2013.01); *A63F 2009/2442* (2013.01); *A63F 2009/2489* (2013.01)

(58) Field of Classification Search

CPC ..... A63F 7/0023; A63F 7/0058; A63F 7/307
USPC ..... 463/9
See application file for complete search history.

(56) References Cited

U.S. PATENT DOCUMENTS

| | | | | |
|---|---|---|---|---|
| 4,163,558 | A * | 8/1979 | Jaworski | A63F 9/14 273/115 |
| 5,820,470 | A * | 10/1998 | Saunders | A63C 19/00 256/25 |
| 6,575,851 | B1 * | 6/2003 | Lamberti | A63B 24/0084 273/395 |
| 6,674,259 | B1 | 1/2004 | Norman et al. | |
| 7,831,337 | B2 | 11/2010 | Greenspan | |
| 7,893,646 | B2 | 2/2011 | Yourlo et al. | |
| 7,974,738 | B2 | 7/2011 | Bruemmer et al. | |
| 8,073,564 | B2 | 12/2011 | Bruemmer et al. | |
| 8,246,050 | B2 | 8/2012 | Do et al. | |
| 8,292,733 | B2 | 10/2012 | Crawford et al. | |

(Continued)

FOREIGN PATENT DOCUMENTS

| | | | |
|---|---|---|---|
| JP | 2009039181 | A | 2/2009 |
| KR | 102002033303 | U | 5/2002 |

(Continued)

OTHER PUBLICATIONS

Angel Osorno and Brandan Sackett, "Hustler's, Inc., Electronic Pool Scoring System", Final Design Report, 2007, 9 pages.

(Continued)

*Primary Examiner* — Omkar Deodhar
*Assistant Examiner* — Shauna-Kay Hall
(74) *Attorney, Agent, or Firm* — Avery N. Goldstein; Blue Filament Law PLLC

(57) ABSTRACT

A robotic gaming system is provided that includes a plurality of modular wall sections placed on playing surface. At least one robot is controlled by a player to navigate on the playing surface and interact with a plurality of scoring elements on the walls. A sensor associated with a scoring elements identifies when the robot successfully interacts with the scoring element to score a point.

20 Claims, 11 Drawing Sheets

(56) References Cited

U.S. PATENT DOCUMENTS

| | | | | |
|---|---|---|---|---|
| 2002/0137427 | A1 | 9/2002 | Peters et al. | |
| 2003/0208304 | A1 | 11/2003 | Peless et al. | |
| 2003/0232649 | A1 | 12/2003 | Gizis et al. | |
| 2006/0063599 | A1 | 3/2006 | Greenspan | |
| 2006/0223637 | A1 | 10/2006 | Rosenberg | |
| 2006/0252340 | A1 | 11/2006 | Bach et al. | |
| 2007/0021241 | A1* | 1/2007 | Geller | A63B 63/004 473/415 |
| 2009/0081923 | A1 | 3/2009 | Dooley et al. | |
| 2009/0170602 | A1 | 7/2009 | Martin et al. | |
| 2009/0248200 | A1 | 10/2009 | Root | |
| 2010/0013153 | A1 | 1/2010 | Yourlo et al. | |
| 2010/0042258 | A1 | 2/2010 | Perlin et al. | |
| 2010/0178994 | A1 | 7/2010 | Do et al. | |
| 2010/0283883 | A1 | 11/2010 | Sato et al. | |
| 2011/0054689 | A1 | 3/2011 | Nielsen et al. | |
| 2011/0065520 | A1 | 3/2011 | Morris | |
| 2012/0208150 | A1 | 8/2012 | Spychaiski | |
| 2012/0238366 | A1 | 9/2012 | Tedder | |

FOREIGN PATENT DOCUMENTS

| | | | |
|---|---|---|---|
| KR | 2020100011328 | U | 11/2010 |
| KR | 2020110005089 | U | 5/2011 |

OTHER PUBLICATIONS

Sara Mitri et al., "Fast Color-Independent Ball Detection for Mobile Robots", Fraunhofer Institute for Autonomous Intelligent Systems (AIS), Schloss Birlinghoven, D-53754 Sankt Augustin, Germany, {firstname.surname}@ais.fraunhofer.de, Jan. 2004, 6 pages.

Sphero, "Connected Toys—Ollie", 2015, 4 pages, http://www.gosphero.com/.

Dr. Graeme Faulkner, "Robot Soccer Balls HiTechnic Wiltronics RCJ-05", 2008, 4 pages, Copyright 2008, http://drgraeme.net/drgraeme-free-nxt-g-tutorials/Ch108/SoccerGenlINXTG/SoccerBall/SoccerBall.htm.

N.K. Hessal, "Okanagan College Robot Games, Soccer Challenge", 2014, 7 pages, Copyright 2014, http://www.okanagan.bc.ca/programs/areas_of_study/engineeringtechnologies/robocup/soccer_challenge.html.

H. Levent Akin, "RoboCup 2011", Jul. 2011, 2 pages, http://www.robocup2011.org/en.

Dan Howarth, "CTRUS Football by Agent", Oct. 7, 2013, 13 pages, http://www.dezeen.com/2013/10/07/ctrus-football-by-agent.

Daily Mail Reporter, Football Joins 21st Century: Premiership Set for Goal-Line Technology (So No More Blaming The Ref!), Jul. 5, 2012, 31 pages, http://www.dailymail.co.uk/sciencetech/article-2169176/Goal-line-technology-finally-signed-Premiership.html.

Robotex, "Football Robot—Robotex Soccer Robots", 2015, 5 pages, Copyright 2014, http://www.robotex.ee/eng/node/364.

* cited by examiner

GAMES PLAYED WITH ROBOTS

RELATED APPLICATIONS

This application is a continuation-in-part of U.S. Ser. No. 14/051,309, filed Oct. 10, 2013, which claims priority benefit of U.S. Provisional Application Ser. No. 61/712,083 filed Oct. 10, 2012; and U.S. Provisional Application Ser. No. 61/870,480 filed Aug. 27, 2013; the contents of the aforementioned applications are hereby incorporated by reference.

FIELD OF THE INVENTION

The present invention in general relates to entertainment and games, and in particular to walls for an arena for robotic games for the general public.

BACKGROUND OF THE INVENTION

Most robot games are intended for the robots to push each other around (sumo), destroy each other (e.g., BattleBots, RoboWars, etc.), or play some form of soccer (push/roll/kick a ball into a goal). In addition, some robot games are designed for a specific purpose for hobbyists and educational competitions (e.g., First, etc.). In a particular game played on a pool or billiard table surface, competing robots are used to score points by pushing or knocking pool balls into the table pockets. A traditional billiard or pool table has six pockets for aiming at and targeting pool balls, with four pockets positioned at the corners of the table, and two pockets positioned at each of the midpoints of the table lengthwise sides. However, there are currently no automated methods for identifying when and which balls fall into which pockets of a billiard table.

Thus, there exists a need for mass-produced robotic games for the general public. There also exists a need for an automated method and system for identifying when and which balls fall into which pockets.

SUMMARY OF THE INVENTION

A robotic gaming system is provided that includes at least one sensor placed on a playing surface. At least one robot is controlled by a player to navigate on the playing surface and manipulate at least one target towards a gate. The sensor is operative for identifying when the target is moved to a scoring region of the playing surface. A robotic game is also provided that includes a plurality of master robots, each of the master robots uniquely assigned to a player. One or more slave targets is uniquely assigned to each of the master robots. A controller is assigned to each player for interactive control of an assigned master robot and corresponding slave targets on a playing surface. The game concludes when all of the slave targets of competing players have been eliminated from the playing surface.

A process for playing a robotic game includes electronically coupling at least one first competitor slave target, each of the at least one first competitor slave target having intelligence to a first competitor master robot. At least one second competitor slave target is coupled thereto and having intelligence to a second competitor master robot. The at least one first competitor slave target, the at least one second competitor, the first competitor master robot, and the second competitor master robot and placed onto a playing field. Functionality of the first competitor master robot is reduced when the at least one first competitor slave target is removed from the playing field alone or in combination with reducing or eliminating functionality of the second competitor master robot when the at least one second competitor slave target is removed from the playing field.

DETAILED DESCRIPTION OF THE INVENTION

The present invention has utility as a robotic game that integrates the functions of robots with portable electronics, such as smart phones. Embodiments of the robotic game provide matched sets of a single "master" robot and multiple "slave" targets to play a game that is similar to last combatant standing games such as "Cut Throat" (three person pool game). In an embodiment of the robotic game, when the targets of a master robot are eliminated from the game, the master robot is caused to have reduced functionality (such as motion stop), and the winner is the last one to have functioning (living) slave targets.

In another embodiment, the present invention has utility as an automated method and system for identifying when and which pool balls fall into which pockets of a billiard table. The identification of a pool ball in a pocket may be used for scoring traditional games of pocket billiards, or for scoring robotic based games played on the surface of the billiard table. For example, the numeric values printed on the face of the pool balls may be added to determine a winner of a game based on a total score of values of those balls knocked in by a player by themselves or by controlling a robot.

Figure 1:
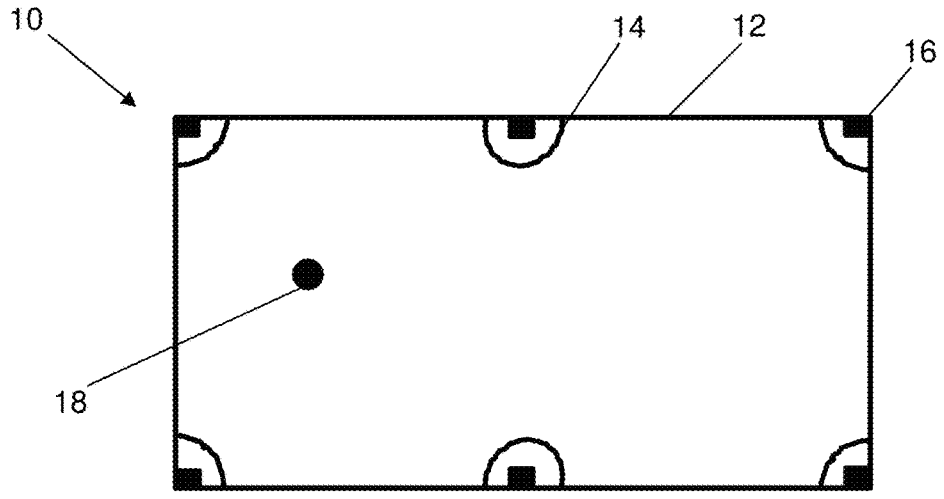
FIG. 1 is a top down view of a billiard table with identification and tracking sensors positioned in the table pockets according to embodiments of the invention.

As seen in FIG. 1, a system is shown generally at 10, defined by a wall 12 and having sidewall gate 14 and a corner gate 16, each having a sensor. The sensors in each instance are independently a camera, an electric eye, and RFID antennae, a force sensor, or an inductive sensor, or a combination thereof. For the purposes of explaining various embodiments of the present invention a "pocket" of a billiards-like playing surface and a "gate" of an opening above the plane of the playing surface for receiving a "target" are used synonymously. Similarly, a ball is defined herein as a subset of various targets that are moved in the present invention game by a robot. It is appreciated a single robot can be used to play a timed game relative to a competitor, or multiple robots simultaneously compete to move targets on the playing surface.

Figure 2:
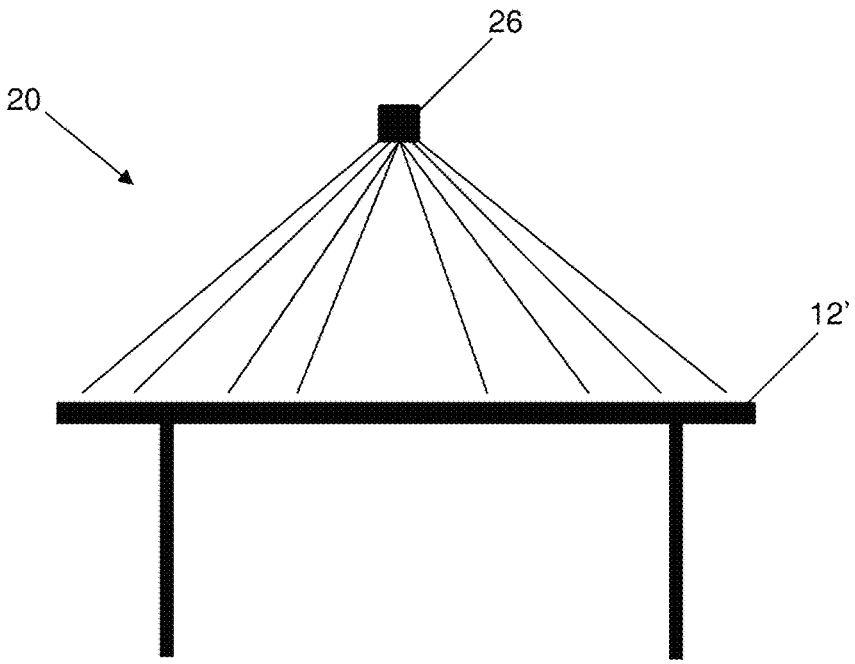
FIG. 2 is a side perspective drawing showing a billiard table with an identification and tracking sensor suspended above the table according to embodiments of the invention.

In FIG. 2 a system is shown generally at 20, an overhead sensor 26 observes targets on the playing surface 12'. It is appreciated that the playing surface 12' is like that of FIG. 1, or has alternative shapes, non-planar topography, obstacles, or combinations thereof.

By way of example, a video camera is present as a sensor 26 and mounted above the playing surface for implementing: vision system software to track spherical (pool ball) targets going into pockets of pool table, and for broadcasting video of the game so the game can be played remotely and for instant replay. A laser system in some embodiments is mounted above the playing surface for indicating lines on the playing surface for play of cues and balls.

Figure 3A:
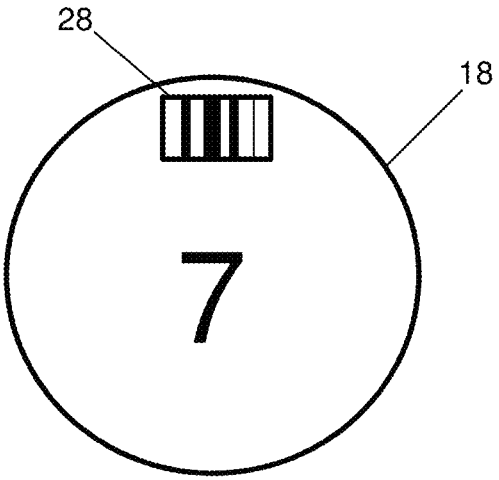
FIG. 3A is a side perspective view of a pool ball with an identification barcode according to embodiments of the invention.

In some embodiments, a sensor 14, 16, or 26 tracks and identify individual targets with character recognition of the number printed on the balls surface (e.g. numbered 1 through 15 with no change to the existing pool balls appearances) when they go into any of the pockets (assigned numbers 1 through 6). Alternatively, each of the pool balls have unique machine readable (vision) markings 28 (in addition to the standard markings of numbers, colors and stripes) for each ball 18 (1 through 15) that are operative with the identification vision system as shown in FIG. 3A. Markings 28 may include barcodes, quick response (QR) codes, or other coded representations of numbers.

Figure 3B:
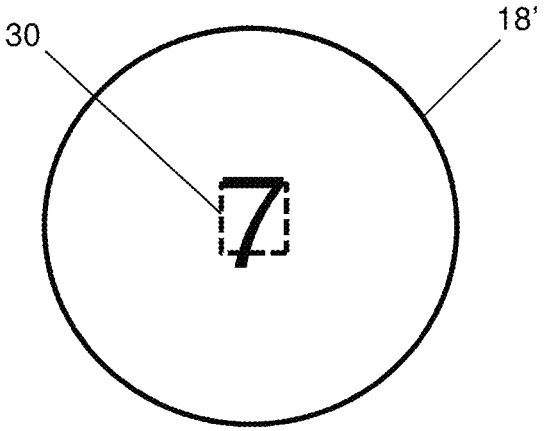
FIG. 3B is a side perspective view of a pool ball with a unique machine readable or recognizable electronics/component (RFID, magnets, etc.) embedded inside according to embodiments of the invention.

In an alternative embodiment of the inventive pool ball identification system, each of pool balls 18' may have a unique machine readable or recognizable electronics/components (RFID, magnets, etc.) embedded inside each ball (1 through 15) 30, as shown in FIG. 3B. Sensors operative to read and determine the type (number value) based on the radio frequency identification (RFID), magnet, or other electronic embedded components, may be positioned at each of the pockets. Alternatively, a sensor system may be placed on, around, under, or above the table that can track and identify individual balls (1 through 15) when they go into any pocket (1 through 6).

Figure 4:
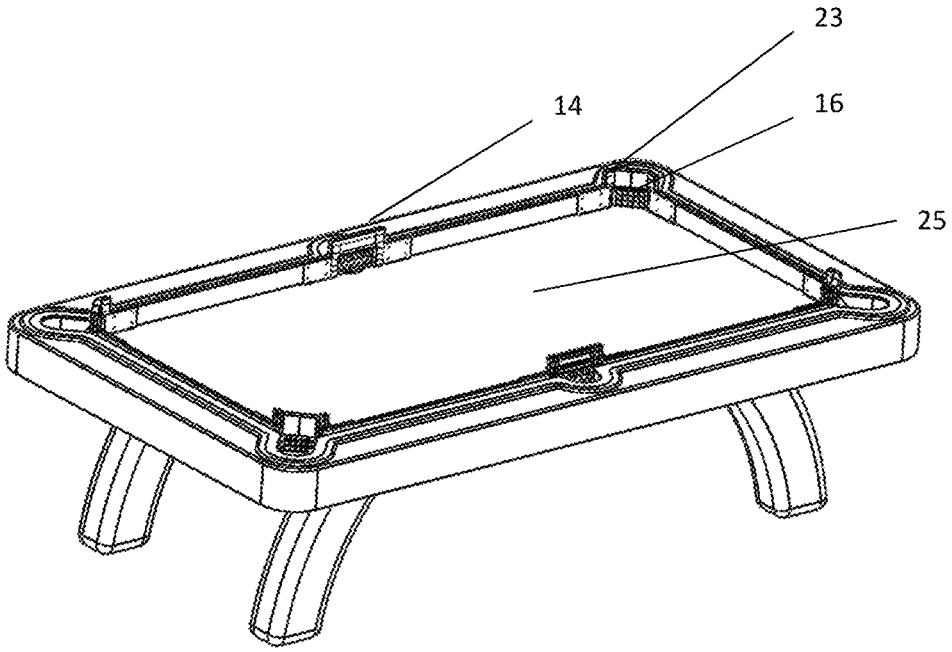
FIG. 4 is an elevated perspective view of playing table for inventive games.

In an embodiment of the inventive gaming system, a playing surface mat embedded with tracking and identification sensors 14 or 16 with such sensors mounted on gate-like goals 23, as shown in FIG. 4, where like numerals correspond to the meanings assigned thereto with respect to previously detailed drawings. The mat 25 in some embodiments retrofits onto a conventional billiards table and may be used to track the balls. The mat 25 may have a plain felt like finish, as found on billiard tables, without any markings, or may have markings related to a game, such as a robotic game with graphics and indicators for positioning game pieces before play begins (and to protect pool table felt). In some inventive embodiments, the mat 25 may have Intelligence to monitor game pieces, and/or electronic graphics for visual stimulation of the players and audience. The mat 25 may also be rolled up in some embodiments to promote transport and storage.

Figure 5:
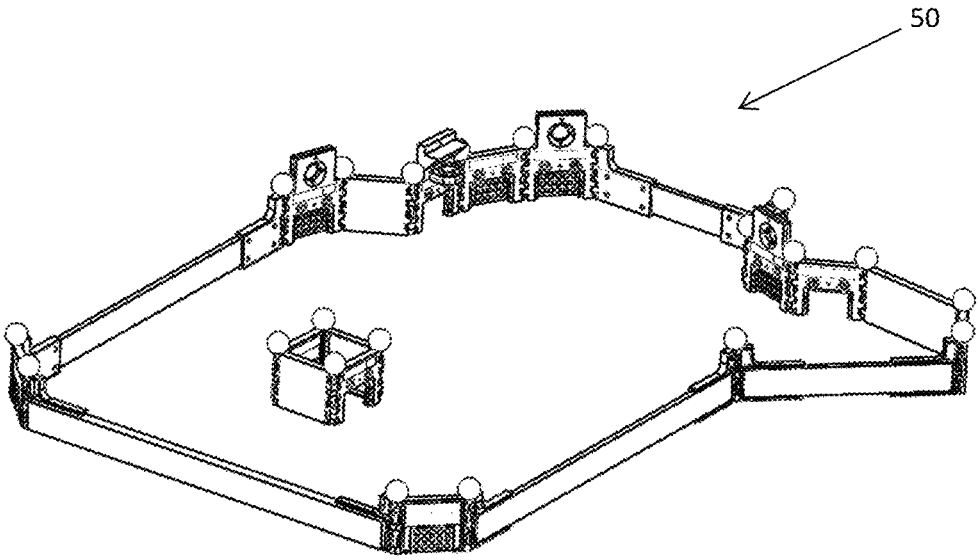
FIG. 5 is an alternative construct of a playing area for an inventive game.
Figure 6A:
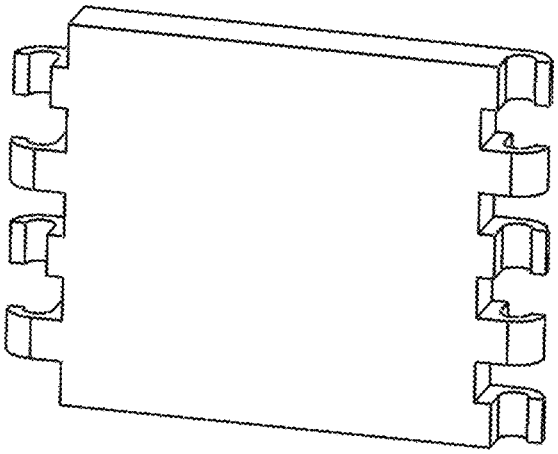
FIGS. 6A-6E are perspective images of a wall section (FIG. 6A), various gate sections (FIGS. 6B-6D) and a pin (FIG. 6E) for joining the aforementioned sections together.
Figure 6B:
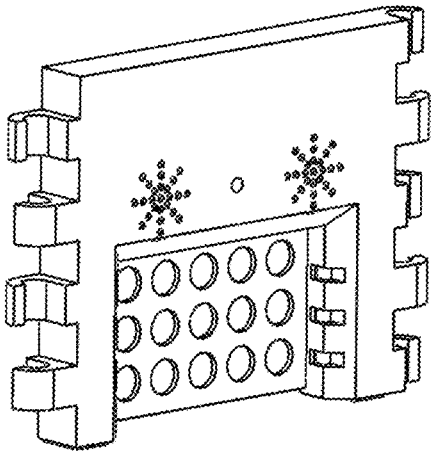
Figure 6C:
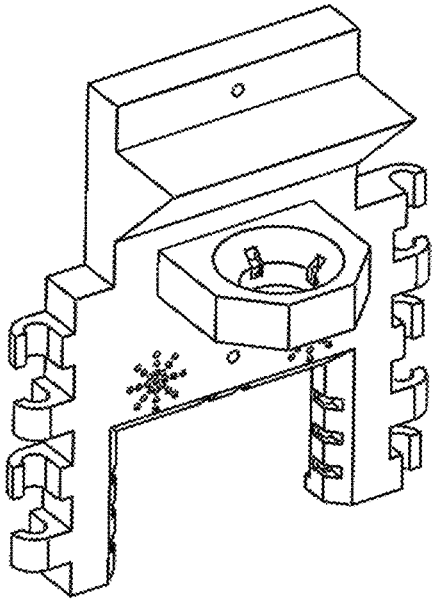
Figure 6D:
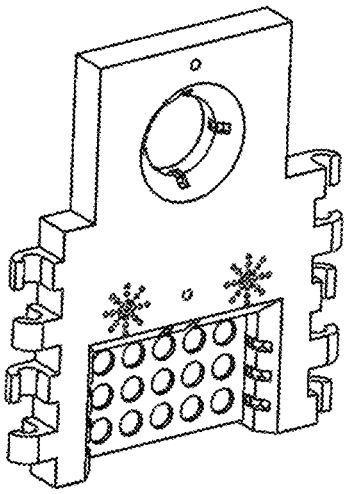
Figure 6E:
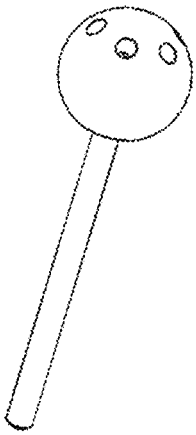

A de novo playing surface is also constructed in user selected configurations based on modular components and is shown generally at 50 in FIG. 5. The playing surface 50 is readily bounded with wall sections (FIG. 6A), gate sections (FIGS. 6B-6D) and pins (FIG. 6E). Sensors 14 or 16 per FIG. 1 are present in gate sections ((FIGS. 6B-6D). It is appreciated that a gate section is used in certain inventive embodiments as having a thresholding function to, for example, replenish munitions in those variants of the invention in which a weapon is present on a robot, or as a battery recharge station for a robot.

Figure 7:
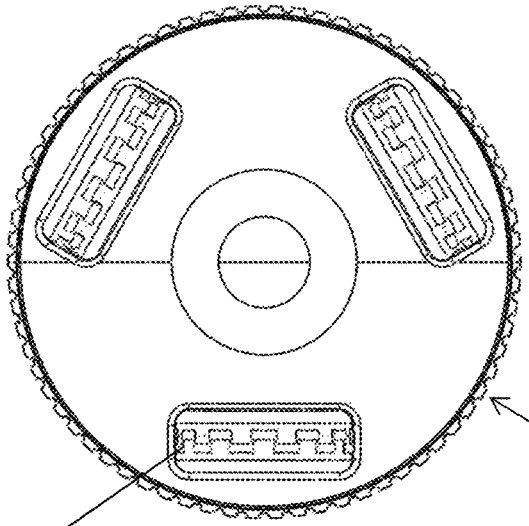
FIG. 7 is a side view of an embodiment of a robot operative in the present invention.
Figure 8:
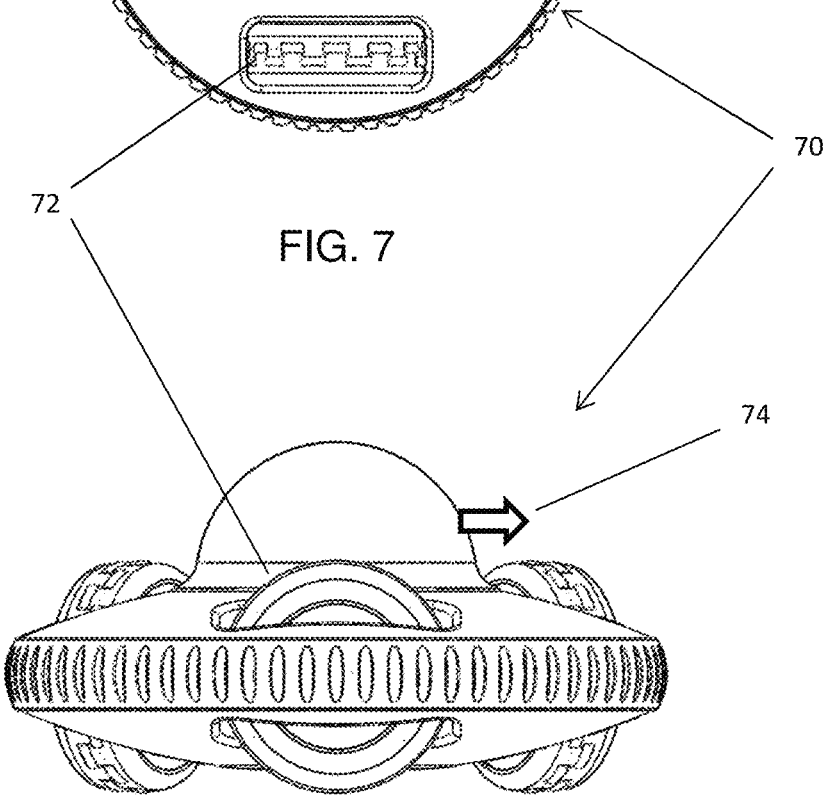
FIG. 8 is a bottom view of the robot shown in FIG. 7.

An exemplary robot of operation in an inventive game is shown generally at 70 in FIGS. 7 and 8. The robot 70 is characterized by at least one drive wheel 72 and an ability to steer the robot 70. In a preferred embodiment an application program operating on a smart phone or tablet device controls the movement of the robot 70. A weapon 74 is provided in some embodiments to impede the activities of a competitive robot from moving targets 18. As noted above the sensor used in the robots would be operative to recognize targets 18 with unique machine readable or recognizable electronics/components (RFID, magnets, etc.) inside each ball (1 through 15), or machine readable (vision) unique marks (in addition to the standard markings of numbers, colors and stripes) for each ball (1 through 15), or the markings and colors (stripes and solids and numbers 1 through 15) on a typical set of pool balls.

Figure 9:
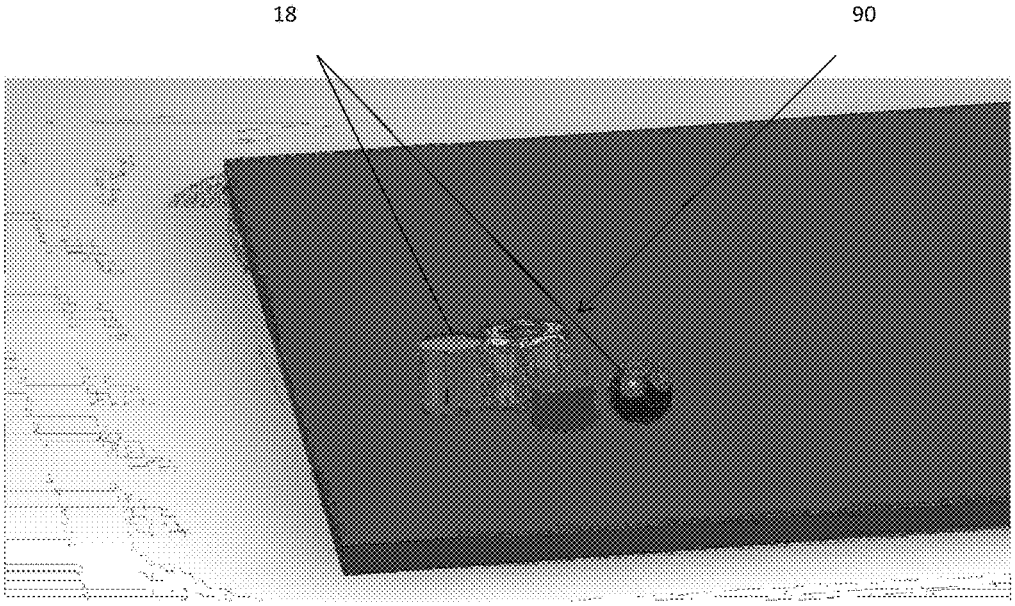
FIG. 9 is a perspective view of another embodiment of robot operative in the present invention and depicted in the context of a playing field and various targets of a ball and cylinders.
Figure 10:
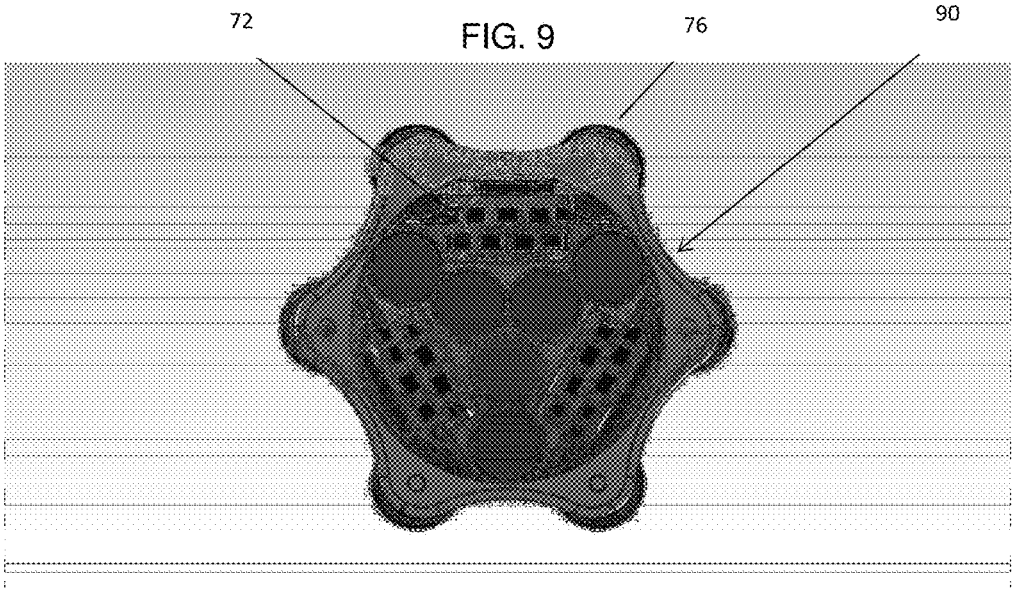
FIG. 10 is a bottom view of the robot shown in FIG. 9.
Figure 11:
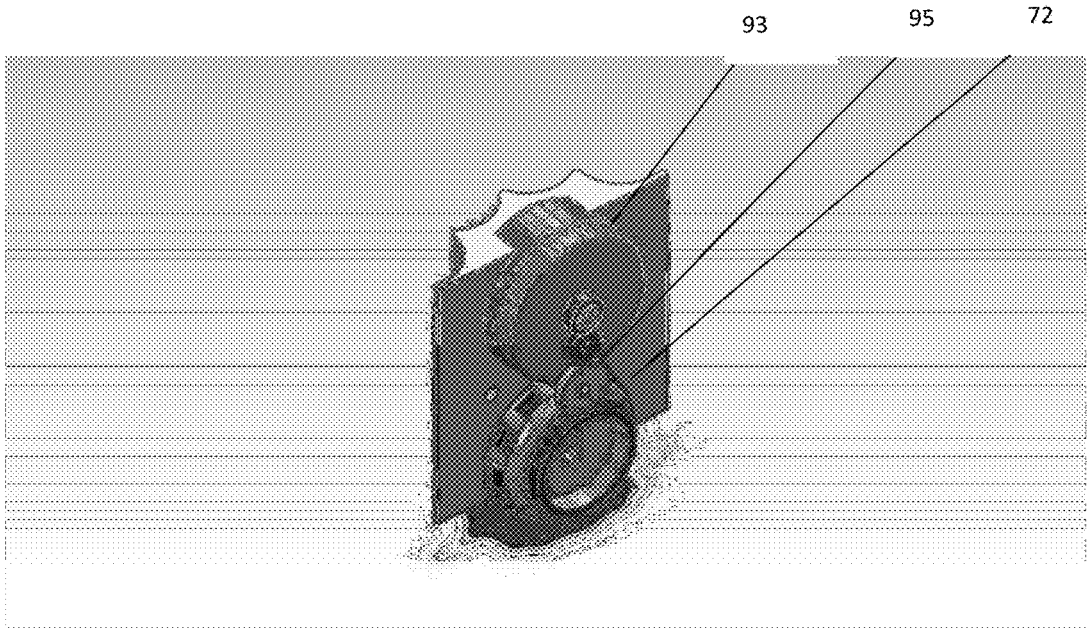
FIG. 11 is a view of the drive system for a wheel of a robot of FIG. 9.

An alternative shape of a robot operative on a playing surface 12, 12', or 50 is shown generally at 90 in FIGS. 9-11, where like numerals have the meaning associated with the aforementioned drawings. Rollers 76 are provided on the exterior in some embodiments to allow for robots to slide relative to other robots or targets 18. A drive system for a wheel 72 is shown in FIG. 11, where a remotely controlled motor 93, operating in both forward and reverse rotational directions is mechanically coupled to the wheel 72 by gearing 95.

In certain embodiments of the present invention, a target identification system may be communication with a central controller or computing device by wireless or wired connection. In other embodiments of the present invention, a display for showing scoring, current status of the pool balls, and other gaming parameters are in communication with a target identification system.

In another embodiment, the robots push targets around and/or release weapons 74, which require targets and robots being confined to a defined play space, with a scoring technique for the targets and weapon's munitions used during play or other scoring technique for assessing a success for a given player.

Game components for a weapons based game include at least one robot—one per person/team. The at least one robot having locomotion and a weapons platform. In some specific embodiments, the robot is a tracked vehicle that functions similar to a military tank. In some embodiments, targets 18 as provided illustratively include a ball, a puck, a can, or a combination thereof. It is further appreciated that games can be played with multiple targets, of like or different size and shape relative to one another to be manipulated as a basis for scoring. A weapon with munitions mounted on at least one of the robot illustratively includes a projectile launcher, a visible light beam, a laser beam, an IR beam, a water cannon, a gas gun, a flame-thrower, a missile, an aircraft, a rocket, an obstacle launcher, fireworks, or combinations thereof. A robot in some embodiments has as a controller a smart phone or tablet device with one player per robot or a second team player acting as a gunner or tactician. The game controller ties the playing surface 12 as defined by the sections, robots and controllers together to score and control the game. In some embodiments, the controller is installed in a section or mat as defined above.

It is appreciated that various games are readily developed based on the robots, targets and playing surfaces as defined herein. These games include:

1. Multiple Robots play a simultaneous pushing game with targets—when the targets associated with a Robot are pushed out of the game (thru a target gate in a Stadium Wall Module), that Robot is disabled from playing the game (shuts down movement) while the other Robots continue to play. Play continues until there is only one Robot with live targets left (the winner!).
2. Multiple Robots play a simultaneous pushing game with targets—the first Robot to push all of its associated targets out of the game (thru a target gate in a Stadium Wall Module), is the winner.
3. Single Robot plays a timed pushing game with targets—when the targets are pushed out of the game (thru a target gate in a Stadium Wall Module), time is recorded—fastest time is the winner.
4. Single or multiple Robots play a timed game in the Stadium touching/hitting/approaching/shooting features (Buttons, Bumpers, Sensors, Opening, target gates, munition gates, etc.) on/in the Stadium Wall Modules using the Robots, targets and munitions.
5. Limit munitions/battery power for a robot, with resupply coming at the cost of objective completion opportunities.
6. Single or multiple Robots play a scoring game in the Stadium touching/hitting/approaching/shooting features (Buttons, Bumpers, Sensors, Openings, target gates, munition gates, etc.) on/in the Stadium Wall Modules using the Robots, targets and munitions—high score is the winner
7. Single or multiple Robots play a video-like game of sequential challenges.
8. Combinations of the above.

Variations on a bounded playing surface 50 illustratively include:

1. Which, when assembled, enclose the Robots and targets in a defined space for playing games
2. That rest primarily on a horizontal playing surface (Billiards Table, Craps Table, Ping-Pong Table, Floor, Driveway, Table, etc.)
3. With target gates that allow the targets to pass thru a gate section to be scored
4. With target gates that allow the targets to pass thru, said gate section having means to identify targets as they pass through (see target Reading Device below) out of the Game (or to be collected and re-used during game)
5. With target gate sections which have means to automatically close/open (Gates, Doors, Windows, Bars, etc.)
6. With target gate sections which have means to indicate (lights, flags, etc.) if they are open or closed (a closed gate could score negative points)
7. With target gate sections which are different sizes (smaller size scores more points)
8. With target gate sections that physically align to pockets on a Billiard Table (targets could be Pool Balls)
9. With target gate sections that collect/control the targets for other purposes
10. With means to re-introduce the targets to the Game/Stadium for continued play
11. With Buttons and/or Sensors that can be activated by pushing/touching/approaching/shooting with Robots, targets and/or munitions.
12. Which incorporate munition gates, for the Weapons to fire munitions at and score points
13. With munition gates that can distinguish munitions from different Robots
14. With dedicated munition gates that are capable to detect one type of munition (Projectile, Visible Light Beam, Laser Beam, IR Beam, Water, Gas, Flame, Missile, Airplane, Rocket, Firework, etc.)
15. With munition gates that are capable to detect multiple types of munition (Projectile, Visible Light Beam, Laser Beam, IR Beam, Water, Gas, Flame, Missile, Airplane, Rocket, or Firework, etc.)
16. With munition gates at various (adjustable?) angles and sizes to vary difficulty of hitting
17. With Blocks of various size, shape and location to vary difficulty of hitting munition gates
18. With Back-Boards (Mirror, angled Wall, etc.) of various size, shape and location to vary difficulty of hitting munition gates
19. With capability to install other munition gates
20. With Garage feature to store and re-charge Robot(s)
21. With Garage feature including a Door, with Door opening to start Game
22. With Garage feature that acts as a sizing gage for Robots—if it does not fit in the Garage, it is too big to play
23. Which contains a Game Brain (game controller) that is linked to the Robot Controllers (smart phones) and other Stadium Wall Modules for scoring and game control
24. That communicate the status of the target gates, Buttons, Sensors, munition gates, etc. to the Game Brain
25. With Lights for various visual effects
26. With a Scoreboard/Display
27. With Speakers for various sound effects
28. With Microphones for other applications
29. With Cameras (pan, tilt, zoom) for remote viewing by fans
30. With Batteries
31. With Connector for power input
32. With Connector for wire to communicate and/or power with other Wall Modules
33. With Wireless connection
34. With Link feature on each end to enable physically joining a series of Modules
35. With Hinge feature on each end to enable linking Modules together with a Hinge Pin
36. With features (Holes) to enable installation of support beams for a Canopy/Tent
37. With Pads on the bottom for anti-skid and mating surface protection
38. With cosmetic features to mimic Buildings, Arcade Games and Boardwalk Rides (Garage, Fun House, Shooting Gallery, Haunted House, Basketball, Baseball, etc.)
39. With Stands/Seats to display Avatar "Fans" (interface same as in/on the Robots)

40. Which contain no electronics for in-expensively increasing Stadium size
41. Which incorporate standard lumber sizes (1×4, 2×4, etc.)
42. That contain features from all of the above Various methods of target reading are contemplated relative to the position of a gate are provided. These methods illustratively include:

Provide a Vision System (video camera) at each target gate that can view individual targets (Balls) when they pass thru that gate.

Provide a System whereby the Video from each camera can be viewed on a display (locally or remotely) by people (judges) and the people/judges can determine which targets pass through which target gate and at what time during the Game.

Provide Controls for the Judges that give feedback to the Game Brain (diminishing or enhancing robots, scoring points, timing, etc.) based on the circumstances of the game.

Provide a System to record and play back the Video from each target gate for "instant replay" determination of who scores/wins the game. The Video playback could be made available to the players on their smart-phones or to remote judges.

Provide a Time Stamp on each Video which will enable judges to determine the order of finish.

The System could use various technologies for the Transmission of information about the target gates/targets to the game controller such as wire, cell phone, radio, internet, Skype, computer network, Wi-Fi, Bluetooth etc.

A munitions reading device for scoring is also provided in some inventive embodiments. Such devices illustratively include:

Projectile:
1. Provide Projectiles (Balls, Cylinders, Bullets, Missiles, etc.) on the Robots with machine readable (vision) unique Marks or Colors for each Projectile
2. Provide a means on each Robot to fire the Projectile
3. Provide a Vision/Electronic System at each Projectile munition gate that can identify individual Projectiles (Marks or Colors) when they pass thru that gate.
4. Provide a Vision/Electronic System placed on, around, under or above the Stadium that can track and identify individual Projectiles when they pass thru any munition gate
5. Said System could use various technologies to identify the Marks or Colors on the Projectiles such as Vision, OCR, Bar Code Reader, Laser, Color Recognition etc.
6. Provide means to Transmit the information about the Projectiles to the Game Brain such as wire, cell phone, radio, internet, Skype, computer network, Wi-Fi, Bluetooth etc.
7. Score the munition Light Beam:
1. Provide Light Beams on the Robots with different frequencies/colors/pulse-rates for each Robot/Weapon
2. Provide means on each Robot to fire the Light Beam
3. Provide an electronic system at each Light Beam munition gate that can sense and differentiate the different frequencies/colors/pulse-rates of the Light Beam when they hit or pass thru that gate
4. Provide means to Transmit the information about the Light Beams to the Game Brain such as wire, cell phone, radio, internet, Skype, computer network, Wi-Fi, Bluetooth etc.
5. Score the munition Laser Beam:
1. Provide Laser Beams on the Robots with different frequencies/pulse-rates for each Robot/Weapon
2. Provide means on each Robot to fire the Laser Beam
3. Provide an electronic system at each Laser Beam munition gate that can sense and differentiate the different frequencies/pulse-rates of the Laser Beam when they hit or pass thru that gate
4. Provide means to Transmit the information about the Laser Beams to the Game Brain such as wire, cell phone, radio, internet, Skype, computer network, Wi-Fi, Bluetooth etc.
5. Score the munition IR Beam:
1. Provide IR Beams on the Robots with different frequencies/pulse-rates for each Robot/Weapon
2. Provide Means on each Robot to fire the IR Beam
3. Provide an electronic system at each IR Beam munition gate that can sense and differentiate the different frequencies/pulse-rates of the IR Beam when they hit or pass thru that gate
4. Provide means to Transmit the information about the IR Beams to the Game Brain such as wire, cell phone, radio, internet, Skype, computer network, Wi-Fi, Bluetooth etc.
5. Score the munition Water:
1. Provide or produce Water on the Robots with different colors/chemistry for each Robot/Weapon
2. Provide means on each Robot to shoot the Water
3. Provide an electronic system at each Water munition gate that can sense and differentiate the different colors/chemistry of the Water when it hits or passes thru that gate
4. Provide means to Transmit the information about the Water to the Game Brain such as wire, cell phone, radio, internet, Skype, computer network, Wi-Fi, Bluetooth etc.
5. Score the munition Gas Gun:
1. Provide or produce compressed Gas on the Robots with different colors/chemistry for each Robot/Weapon
2. Provide a means on each Robot to shoot the Gas
3. Provide an electronic system at each Gas munition gate that can sense and differentiate the different colors/chemistry of the Gas when it hits or passes thru that gate
4. Provide means to transmit the information about the Gas to the Game Brain such as wire, cell phone, radio, internet, Skype, computer network, Wi-Fi, Bluetooth etc.
5. Score the munition.

Obstacle Layer:
1. Provide obstacles that are dropped onto the playing surface to impede competitive robot
2. Provide a means on each robot to drop the obstacle
3. Provide an electronic system to indicate when a robot contacts an obstacle
4. Provide means to transmit the information about the obstacle contact such as wire, cell phone, radio, internet, Skype, computer network, Wi-Fi, Bluetooth etc.
5. Score the munition Flame:
1. Provide or produce Combustible Fuel for making a Flame on the Robots that produces different colors/chemistry for each Robot/Weapon 2. Provide means on each Robot to ignite and shoot the Fuel/Flame
3. Provide an electronic system at each Flame munition gate that can sense and differentiate the different colors/chemistry of the Fuel/Flame when it hits or passes thru that gate
4. Provide means to Transmit the information about the Fuel/Flame to the Game Brain such as wire, cell phone, radio, internet, Skype, computer network, Wi-Fi, Bluetooth etc.
5. Score the munition Missile:

1. Provide Missiles on the Robots that produces different colors/chemistry/electronic signals for each Robot/Weapon
2. Provide means on each Robot to launch the Missile
3. Provide an electronic system at each Missile munition gate that can sense and differentiate the different colors/chemistry/electronic signals of the Missile when it hits or passes thru that gate
4. Provide means to transmit the information about the Missile to the Game Brain such as wire, cell phone, radio, internet, Skype, computer network, Wi-Fi, Bluetooth etc.
5. Score the munition Airplane:

1. Provide Airplanes on the Robots that produces different colors/electronic signals for each Robot/Weapon
2. Provide means on each Robot to launch the Airplanes
3. Provide an electronic system at each Airplane munition gate that can sense and differentiate the different colors/electronic signals of the Airplane when it hits or passes thru that gate
4. Provide means to Transmit the information about the Airplane to the Game Brain such as wire, cell phone, radio, internet, Skype, computer network, Wi-Fi, Bluetooth etc.
5. Score the munition Rocket:

1. Provide Rockets on the Robots that produces different colors/chemistry/electronic signals for each Robot/Weapon
2. Provide means on each Robot to launch the Rockets
3. Provide an electronic system at each Rocket munition gate that can sense and differentiate the different colors/chemistry/electronic signals of the Rocket when it hits or passes thru that gate
4. Provide means to Transmit the information about the Rocket to the Game Brain such as wire, cell phone, radio, internet, Skype, computer network, Wi-Fi, Bluetooth etc.
5. Score the munition Firework:

1. Provide Fireworks on the Robots that produce different colors/chemistry for each Robot/Weapon
2. Provide means on each Robot to launch the Fireworks
3. Provide an electronic system at each Firework munition gate that can sense and differentiate the different colors/chemistry of the Fireworks when it hits or passes thru that gate
4. Provide means to Transmit the information about the Firework to the Game Brain such as wire, cell phone, radio, internet, Skype, computer network, Wi-Fi, Bluetooth etc.
5. Score the munition In embodiments of the inventive game, the slave targets are electronically intelligent and coupled/matched (owned) to each master robot of each competitor. Furthermore, there can be any number of slaves matched with a single master robot (but the number should be the same for all competing master robots in a single game). When a master robot's slave target is eliminated (or impaired) from the playing field, reduced functionality of the slave owner's master robot can be initiated. Various stages of impaired functionality can be implemented for each slave eliminated. Master robots could display an indication of the number of slaves still "alive" in the game. In embodiments, the game ends when only one master robot has functioning slaves.

Embodiments of the inventive robotic game may be played on a table, pool table, floor or other suitable indoor or outdoor surface (with tape or lines to define the playing field), etc. The object of the game is to push (using the master robot) the opponent's slave targets off the table, into a pocket of a pool table, or out of the demarcated playing field surface. Each player controls one master robot. Each robot can have any number of slave targets.

Embodiments of the master robots in the inventive game may be controlled with a portable electronic device (controller), such as a smart phone, with communication and imaging capabilities, such as a camera. The master robot and slave targets may sync (and link with each other) with the portable electronic device via a bar code, quick response (QR) code, radio frequency identification (RFID), near field communication, Bluetooth, and other identification methods. In an embodiment the barcode may be positioned on the bottom of the robot for scanning or image capture with the portable electronic device. The master robot also may be configured with the ability to sync with the slave targets. The portable electronic device or controller may be configured with software, such as a downloadable application (App) for playing the inventive game. The controller may have inertial sensors to provide a tilt to drive for the robot being controlled i.e.,—more tilt, more speed—horizontal is no speed in any direction. Additional movement control may include "Push to Pass" feature to enable short bursts of speed for the robot. The controlling device may also provide indicators such as a for example a timer to show when the last target was killed—used to decide who wins in close decisions, controls to set the number of targets in a game, a way to connect all controllers in a game so that they can all start the game at the same time. The controller may have display aspects to provide simulated game play to practice the physical game, as well as the ability to control a physical game remotely.

Embodiments of the master robots may be configured with software to keep the robot on the playing field (table), or be user programmable to map the playing field (surface). In addition, the master robots may be equipped with sensors to identify the boundaries or edges of the playing field surface. Embodiments of the software for controlling the master robots may also be configured with a victory "dance" and an introductory "dance" routine program. Embodiments of the robot may have omni-wheel drive so that it can move in any direction at any time (no steering).

Embodiments of the master robot may have a power source such as a battery, lights, vision capability with one or more cameras, and audio capability through a speaker. In an embodiment, the vision system may enable viewing (controlling) the game from the robot's perspective. The robot may be configured with a removable crown which can be illuminated from the bottom with multi-colored light(s) from the Robot. Each crown can be unique by using rapid manufacturing. The robot may have an Indicator to show how many targets are still alive, such as multiple lights to indicate how many targets are left.

Embodiments of the slave targets may have electronic intelligence and two-way communication capability with any master robot, and have an ability to "lock" with one individual master robot. Embodiments of the slave target may have a power source such as a battery, lights, vision capability with one or more cameras, and audio capability through a speaker. An example of audio may be a scream when killed. The slave targets may be equipped with sensors to identify the boundaries or edges of the playing field surface. The slave targets may assume a spherical shape (ball) for rolling on playing field surface (pool table).

Embodiments of the slave targets may be configured with a removable "Head" that can fall off during game, thereby initiating some response from the master robot. In an embodiment, the head that pops off (spring loaded) when eliminated from game (as it goes off a table, into a pocket, over the line). Furthermore, the head may be configured like the back end of a throwing dart (post) to accommodate the "flights" for identification of the targets Embodiments of the slave targets may sync with the portable electronic device via a bar code, quick response (QR) code, radio frequency identification (RFID), near field communication, Bluetooth, and other identification methods. In an embodiment, the barcode may be positioned on the bottom of the slave target for scanning with the portable electronic device.

The game field (table, pool table, floor, etc.) may have lines/tape to identify boundaries. In an embodiment, the playing surface may be a mat with graphics and indicators for positioning game pieces before play begins (and to protect pool table felt). In embodiments, the mat may have Intelligence to monitor game pieces, and/or electronic graphics for visual stimulation of the players and audience. The mat may also be rolled up for easy transport and storage. A video camera may be mounted above the playing surface for implementing: vision system software to track spherical (pool ball) targets going into pockets of pool table; shutting down a master robot when targets are off the playing field; and for broadcasting video of the game so the game can be played remotely and for instant replay. A laser system may be mounted above the pool table for providing indicating lines on pool table for play of cues and balls.

Figure 12:
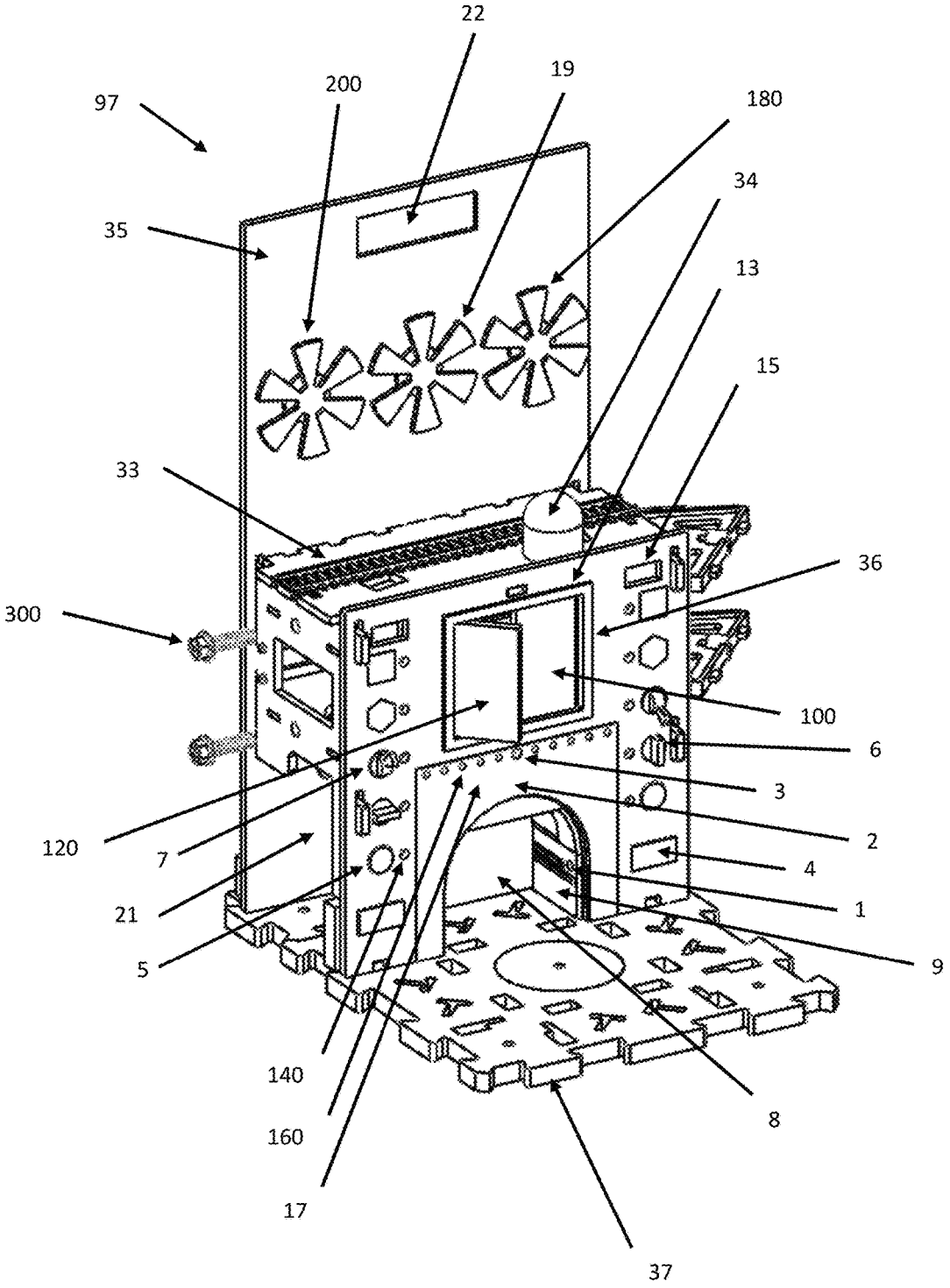
FIG. 12 is a front perspective view of a modular wall section joined with a modular playing surface mat, the modular wall section shown includes a number of various scoring elements.
Figure 13:
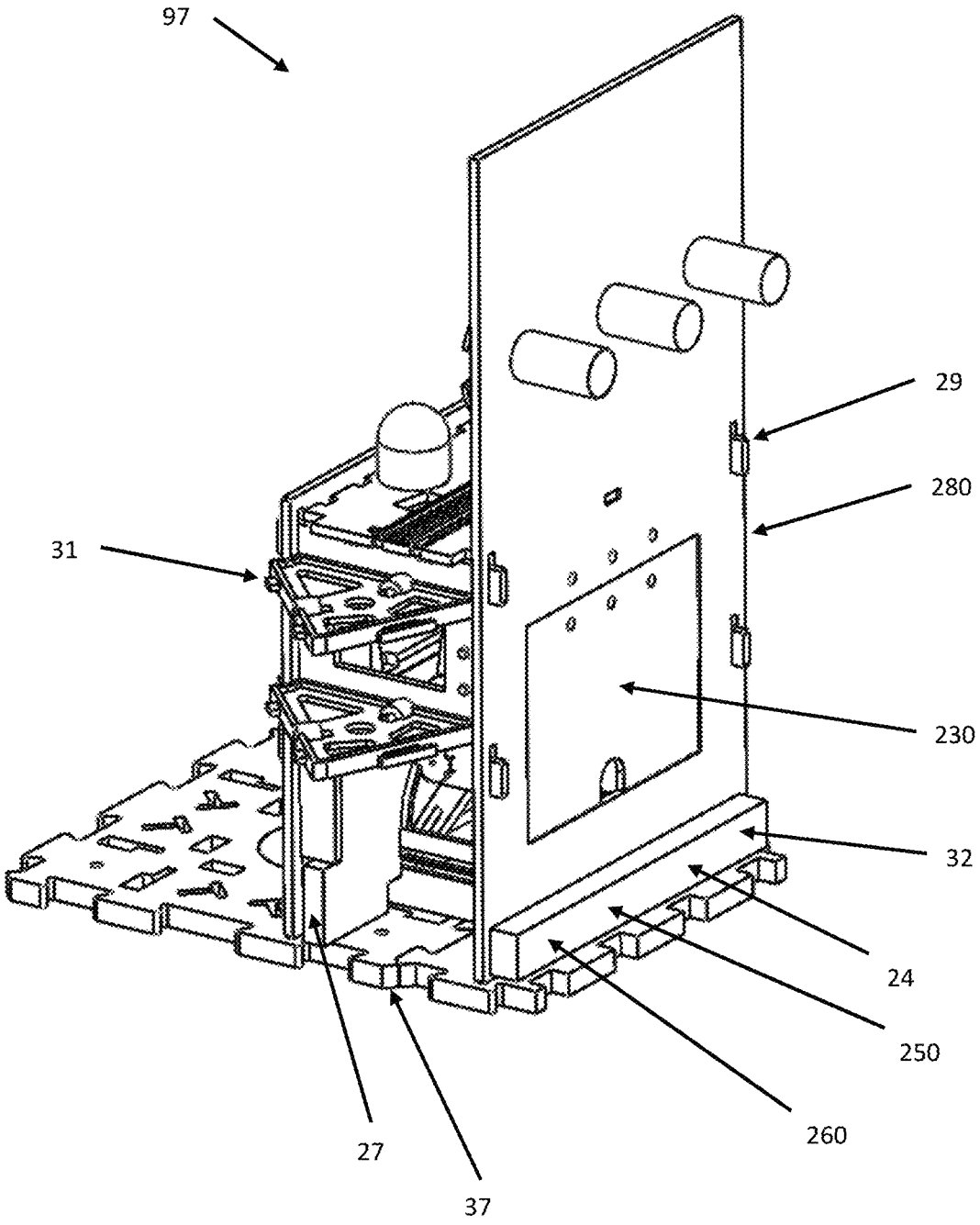
FIG. 13 is a rear perspective view of the modular wall section of FIG. 12.

Embodiments of a robotic gaming system may include a plurality of modular wall sections 97. The modular structures may be made by laser cutting 280, injection molding 36, or any other suitable means. FIG. 12 is a front perspective view of a modular wall section 97. While FIG. 13 is a rear perspective view of the modular wall section 97. The plurality of modular wall sections such as that shown with respect to reference numeral 97 or any of the aforementioned types depicted in FIGS. 6A-6D are placed on a de novo playing surface such as a table or floor or other suitable surface and joined together by fasteners such as bolts or by interlocking elements such as tongues and grooves, pegs and holes, corresponding slots and notches, and the like. The wall sections may include corner braces 31 at various angles such as 15, 30, 45, and 60 degrees. The modular wall sections may be constructed in user selected configurations that are reconfigurable based on the modular wall section laterally joined to define the playing surface. In this way, the playing surface may be designed to fit on a table or within a confined space. Also, the playing area may be expanded as a user obtains more and more modular wall sections, which provides versatility for the robotic gaming system. The modular wall sections include a plurality of scoring elements with which a robot controlled by a player and navigating on the playing surface may interact. Each wall section of the plurality of modular wall sections may have from one or many scoring elements. The gaming system may also include sections of modular wall that do not have any scoring elements. The modular wall sections 37 may include cosmetic panels 35 attached to the walls. Each of the scoring elements has a sensor associated with it that operates to identify when a robot successfully interacts with a given scoring element. A successful interaction with a scoring element results in at least one game point scored for the robot that successfully interacted with the particular scoring element.

As shown in FIGS. 12 and 13, the modular wall section 97 locks into a playing surface mat 37. The playing surface mat 37 is configured to be modular in that it includes interlocking elements that connect with other sections of playing surface mat to create a configurable playing surface. However, the playing surface mat 37 may also be rolled up or a continuous mat. In some embodiments, the playing surface mat 37 is embedded with tracking and identification sensors. In embodiments that include a target or ball on the playing surface, the target or ball may be configured with radio frequency identification, a magnet, or other electronic embedded component to interact with the embedded tracking and identification sensors of the mat 37.

A modular wall section 97 in some inventive embodiments includes a plurality of indicator lights 140 that signal when scoring opportunities are available or when scoring occurs. Alternatively or additionally, these indicator lights 140 are used as part of a gaming mode in which scoring element targets are to be interacted with in various sequential patterns. The modular walls 37 may also include at least one speaker of indicating that a point has been scored and/or that is capable of providing additional sound effects as the game is underway. The modular wall sections 37 may also include an elevated track surface for the at least one robot to navigate, for defensive or target robots 34 to travel upon, or for a train 33 to travel upon. A modular wall section 37 in some inventive embodiments includes at least one display 22 for indicating a present score of the game, when scoring is possible or when a new point is scored, and other visual effects that can distract players and/or add visual interest to the gaming experience. Additionally, a wall section 97 in some inventive embodiments includes a moving component 200 or a fog generator 21 for player distraction and/or visual effect.

The plurality of scoring elements may include bumpers 4 for a robot to hit to score points, buttons 5 for a robot to push to score points, knobs 6 for a robot to turn to score points, and/or toggle switches 7 for a robot to flip to score points. The robot may include an actuator for interacting with the scoring elements, similar to the weapon 74 per FIG. 8. Other scoring elements that may be included in various embodiments of the present gaming system include openings in the walls such as doors 120 or windows 13 through which the robot can shoot a projectile, light beam, laser beam, infrared beam, water jet, missile, rocket, or other weapon 74 to score points. Other scoring elements include stationary or moving projectile targets 19, and/or stationary or moving laser infrared, or light targets 180 that the robot can shoot with a projectile, light beam, laser beam, infrared beam, water jet, missile, rocket, or other weapon 74 to score points. Sensors 1 or 2 associated with each scoring element signal when a point is scored and communicate with a central processor 250 for programming and scoring. The central processor can then communicate the score to the display, lights, and/or speakers. It is appreciated that the central processor 250 has a wired or wireless link to a remote computer or smart phone controller, the remote computer or smart phone controller including software to allow for programming of the central processor 250 to vary factors such as the type of game being played, scoring, handicapping certain players to account for ability, and exchange of scoring therebetween.

In some inventive embodiments that include at least one target or ball on the playing surface, at least one modular wall section may include an opening through which a robot can pass the target or ball and a sensor 1 associated with that opening can identify when the target passes through the opening to score a point. The sensor associated with the opening or another sensor 2 associated with the opening can identify the targets when the pass through the opening in the walls. Additionally, sensors 3 or cameras 17 can also view the area in front of the wall looking for targets or balls and/or robots. The openings for targets or balls in the wall sections may include a kicker 8, a flipper 9, or a gate 11 that opens and closes to make passing the target or ball through the opening more difficult. The modular wall sections 97 in some inventive embodiments includes a target return system for returning targets or balls to the playing surface after the targets pass through an opening in the wall sections.

In some inventive embodiments, the modular wall section 97 includes an access door 230 for accessing the components sensors, or scoring elements that are contained within the wall section. The wall section also includes a CPU 24 for programming and controlling the various elements of the game system. The wall section in some inventive embodiments includes a power buss 32 for powering the various components of the game system and there are means 260 to connect to the power buss 32 and/or a communications buss.

Each of these components, sensors, electronics, and/or scoring elements may be individual modules that plug into the power buss and communicate via the Internet, bluetooth, WiFi, wire, or a combination thereof to a control device (PC, tablet, phone, etc.), or they could all be part of one complete assembly that is self-powered or connects to the power buss and communicates via the Internet, bluetooth, WiFi, wire, etc. to a control device (PC, tablet, phone, etc.).

In some inventive embodiments a carrying/shipping/storage/retail/packaging case include at least one of: built-in charging station for the robot(s) and targets; a large battery to support charging; solar panels to support charging; and an electronic tracking device.

Any patents or publications mentioned in this specification are herein incorporated by reference to the same extent as if each individual publication was specifically and individually indicated to be incorporated by reference.

The foregoing description is illustrative of particular embodiments of the invention, but is not meant to be a limitation upon the practice thereof.

The invention claimed is:

1. A robotic gaming system comprising:

a plurality of modular wall sections placed on a de novo playing surface constructed in user selected configurations that are reconfigurable based on the modular wall sections laterally joined to define the playing surface;

at least one robot controlled by a player with a smart phone and navigating on the playing surface;

a plurality of scoring elements on the plurality of modular wall sections with which the at least one robot interacts; and a plurality of sensors operative for identifying when the at least one robot successfully interacts with an element of the plurality of elements;

wherein a successful interaction scores at least one point for the at least one robot.

2. The system of claim 1 wherein at least one of said plurality of modular wall sections includes a plurality of indicator lights that signal when scoring opportunities are available or when scoring occurs.

3. The system of claim 1 wherein at least one of said plurality of modular wall sections includes at least one speaker for indicating scoring and is capable of providing sound effects.

4. The system of claim 1 wherein at least one of said plurality of modular wall sections includes an elevated track surface.

5. The system of claim 1 wherein at least one of said plurality of modular wall sections includes at least one display.

6. The system of claim 1 wherein at least one of said plurality of modular wall sections lock into a playing surface mat.

7. The system of claim 6 wherein the playing surface is a mat embedded with tracking and identification sensors.

8. The system of claim 7 wherein at least one target is configured with at least one of radio frequency identification (RFID), magnet, or other electronic embedded components.

9. The system of claim 1 wherein at least one of said plurality of modular wall sections includes at least one moving component or fog generator.

10. The system of claim 1 wherein at least one of said plurality of scoring elements includes bumpers on the plurality of modular wall sections for the at least one robot to hit to score points.

11. The system of claim 1 wherein at least one of said plurality of scoring elements includes buttons on the plurality of modular wall sections for the at least one robot to push to score points.

12. The system of claim 1 wherein at least one of said plurality of scoring elements includes knobs on the plurality of modular wall sections for the at least one robot to turn to score points.

13. The system of claim 1 wherein at least one of said plurality of scoring elements includes toggle switches on the plurality of modular wall sections for the at least one robot to flip to score points.

14. The system of claim 1 wherein at least one of said plurality of scoring elements includes openings in the plurality of modular wall sections through which the at least one robot can shoot to score points.

15. The system of claim 1 wherein at least one of said plurality of scoring elements includes stationary or moving projectile targets that upon being hit scores points.

16. The system of claim 1 wherein at least one of said plurality of scoring elements includes stationary or moving laser, infrared or light targets.

17. The system of claim 1 further comprising at least one target on the playing surface.

18. The system of claim 17 wherein said plurality of scoring elements includes at least one opening through which the at least one robot can pass said at least one target and wherein said at least one opening includes a sensor to identify when the at least one target passes through the opening to score at least one point for the at least one robot.

19. The system of claim 18 wherein said at least one opening includes a kicker, a flipper, or a gate.

20. The system of claim 18 wherein at least one of said plurality of modular wall sections includes a target return system for returning the at least one target to the playing surface after the at least one target passes through the at least one opening.

* * * * *